US006371853B1

(12) United States Patent
Borta

(10) Patent No.: US 6,371,853 B1
(45) Date of Patent: Apr. 16, 2002

(54) MOTION PINBALL GAME

(75) Inventor: Ronald Borta, Potomac Falls, VA (US)

(73) Assignee: Ronbotics Corporation, Manassas, VA (US)

( * ) Notice: Subject to any disclaimer, the term of this patent is extended or adjusted under 35 U.S.C. 154(b) by 0 days.

(21) Appl. No.: 09/645,574

(22) Filed: Aug. 25, 2000

(51) Int. Cl.[7] ..... A63F 9/24
(52) U.S. Cl. ..... 463/36; 273/118 A; 273/119 A
(58) Field of Search ..... 273/118 A, 119 A, 273/121 A; 472/137; 463/1, 6, 30, 36, 37, 46

(56) References Cited

U.S. PATENT DOCUMENTS 3,675,927 A * 7/1972 Gottlieb et al. ..... 273/119 A
4,650,190 A * 3/1987 Gieger ..... 273/121 A
5,112,049 A * 5/1992 Borg ..... 273/119 A
5,237,887 A 8/1993 Appleberry
5,294,172 A * 3/1994 Dubus ..... 297/148
5,353,242 A 10/1994 Crosbie et al.
5,611,731 A * 3/1997 Bouton et al. ..... 463/37
5,772,513 A * 6/1998 Ohishi ..... 463/46
5,901,612 A 5/1999 Letovsky
5,952,796 A 9/1999 Colgate et al.
5,954,508 A 9/1999 Lo et al.
5,980,255 A 11/1999 Mathieu et al.
6,077,078 A 6/2000 Alet et al.
6,095,926 A 8/2000 Hettema et al.
6,132,314 A * 10/2000 Aiki ..... 463/37
6,142,877 A * 11/2000 Nishimura ..... 463/46

OTHER PUBLICATIONS

Motionbase Brochure, "Interactive leisure simulators, Electrical motion platforms, Visual display systems, Multiple seat motion rides" (Motionbase plc 1997).
Adventure Quest Brochure, "NOW" (pre–1998).
Flight Avionics Brochure, "New '98 Premiering at IAAPA" (1998).
Astro Game Products, Inc. Brochure, "Interactive 3D VIPER Flight simulator" (pre–1998).
Evans & Sutherland Web Page, "Cyber Fighter" at hhtp://www.es.com/Products/Edutain/cyberfighter.html (Nov. 3, 1997).

(List continued on next page.)

*Primary Examiner*—Raleigh W. Chiu
(74) *Attorney, Agent, or Firm*—Foley & Lardner

(57) ABSTRACT

A motion pinball game comprises a player station, a playing field, a motion control interface, and a motion platform. The player station and the playing field are coupled to the motion platform. A motion control interface generates a motion command that is received by a motion platform. The player station and the playing field are set in motion on the basis of the motion command. A player positioned in the player station can generate the motion commands via the motion control interface. This design allows the player to control and experience the same motion as the playing field, which adds to the enjoyment of playing the game.

15 Claims, 13 Drawing Sheets

OTHER PUBLICATIONS

MaxFlight Corporation Interactive Ride Systems Brochure, "Get Ready for some SeriousMotion—Introducing The Next Generation in Motion Technology" (pre–1998) (best available copy).
Sarnicola Simulation Systems, Inc. Advertising Materials (pre–1998).
Thomson Entertainment News Bulletin, "Unreal", vol. 3 (1997).
MaxFlight Corporation Interactive Ride System Brochure, "VR 2002 Roller Coaster" (pre–1998).
Stricor, Inc. Brochure, "Xtreme–Descent II" (pre–1998).
NAMCO America, Inc. Brochure, "Final Furlong" (1997).
Winble, Inc. Brochure, "WINBLE Ride Machine 'WAVE'" (pre–1998).
Adventure Quest, LLC. Brochure, "Personal Motion Theatre M–4" (pre–1998).
Letovsky Dynamics News Bulletin, "News In Motion", vol. 1 (1997).
Servos & Simulation, Inc. Brochure, "Electric Motion System Two Degrees of Freedom Model 710 LP–2" (1997).
MOOG Brochure, "Moog Electric Motion Simulators" (pre–1998).
Servos & Simulation, Inc. Brochure, "Six Degrees of Freedom Electric Motion System Model 710–6–2000" (1997).
Servos & Simulation, Inc. Brochure, "Two Degrees of Freedom Electric Motion System Model 710–2" (1997).
Servos & Simulation, Inc. Brochure, "Electric Motion System High Angle Two Degrees of Freedom" (1997).
Servos & Simulation, Inc. Brochure, "Three Degrees of Freedom Electric Motion System Model 710–3–2000" (1997).
MaxFlight Corporation Interactive Ride Systems Brochure, "VR2000 Flight Simulator" (pre–1998).
Ronboltics Corporation Motion Ride "CoasterRider X–Press" (1999).

* cited by examiner

MOTION PINBALL GAME

BACKGROUND OF THE INVENTION

This invention relates to a novel motion pinball game. More specifically, this invention relates to a pinball game where the pinball playing field and the player station undergo motion. The player station and pinball playing field are configured to be mountable to an electric motion platform that includes a control system coupled to a player motion control interface for controlling movement of the player station and pinball playing field.

Various versions of what is commonly understood to be a pinball game have been around for centuries. Three centuries ago, a ball and board game called "labyrinth" was created by the Egyptians. This game consists of a moveable board in which a player alters the orientation of the board in order to move a small ball around a maze formed on the board surface. Thus, labyrinth can be considered an active pinball game in that the playing field moves, but where the player is stationary.

A century or so later, a static pinball game, now known as "Pachinko," was developed. This pinball game consists of a vertically oriented stationary playing field having pins and slots. To play the game, a player releases a ball which travels from the top portion of the playing field, under the force of gravity, and bounces off of the multiple pins into various slots to score points. The ball's final resting place is left to chance as the player has no control over the ball's motion down the playing field.

In the 1940's and 1950's, a modern day pinball game emerged. This game consists of a rectangular, tilted playing field consisting of various bumpers, gates, and holes. A player releases a metal ball, usually steel, into the playing field via a spring loaded pin. The ball moves down the playing field under the force of gravity. Slight alteration of the ball's path can be initiated by the player, who can bump or jostle the playing field's housing. The ball eventually rests in a hole, and a point total is determined. In the late 1950's or early 1960's, flippers were developed to allow the player to alter the movement of the ball back up the playing field. Multiple variations of the playing field have been developed, although the basic concept has remained the same: the player and the playing field are stationary.

SUMMARY OF THE INVENTION

Accordingly, it is therefore a general object of the present invention to provide a motion pinball game, where both the player and the pinball playing field are in motion, and where the player controls that motion.

According to an embodiment of the present invention, a motion pinball game comprises a player station, a playing field, a motion control interface, and a motion platform. The player station and the playing field are coupled to the motion platform. The motion platform receives motion command signals from the motion control interface to move the player station and the playing field.

According to a preferred embodiment of the invention, the motion platform comprises a base, a top, and a support member for supporting the top relative to the base. The motion platform also has a pair of positioning motor assemblies mounted to the base and an arm assembly extending between each of the positioning motor assemblies and the top of the platform. The arm assemblies are responsive to rotary motion of a respective one of the positioning motor assemblies and are adapted to rotate 360 degrees about the respective positioning motor assembly. The motion platform further includes a microcontroller electrically connected to the positioning motor assemblies for controlling rotational speed and rotational direction of the positioning motor assemblies and thus angular displacement of the top of the motion platform relative to the base. Motion control signals generated by the motion control interface are processed by the microcontroller. The motion platform has two degrees of freedom, pitch and roll.

Additional objects and advantages of the invention will be apparent to those of ordinary skill in the art from the following description of a preferred embodiment, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and, together with the general description given above and the detailed description of the preferred embodiment given below, serve to explain the principles of the invention.

DETAILED DESCRIPTION OF THE PREFERRED EMBODIMENT

Figure 1:
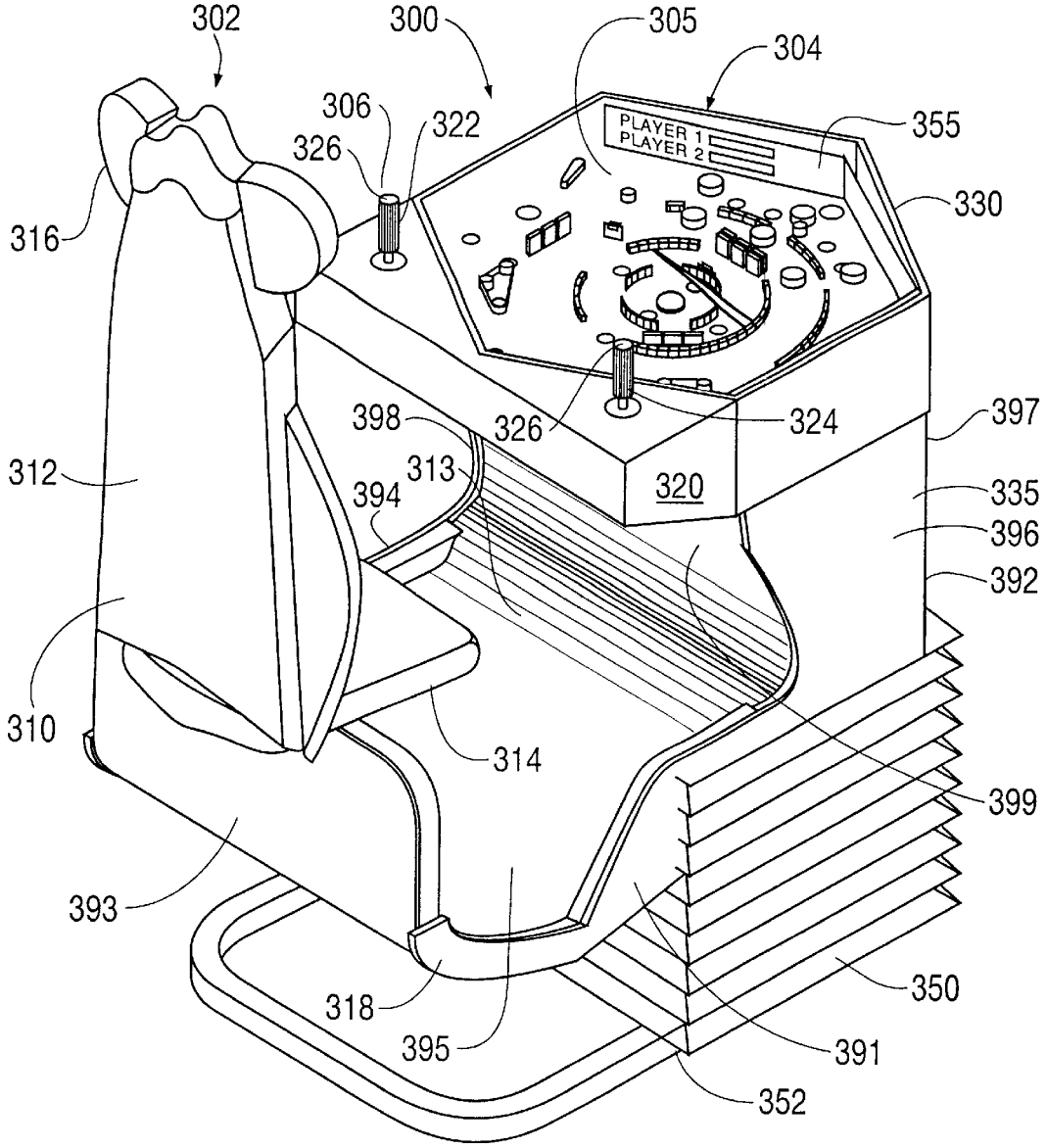
FIG. 1 is a perspective view of a motion pinball game according to an embodiment of the present invention.

Referring now to the drawings, wherein like numerals indicate like parts, and initially to FIG. 1, there will be seen a schematic, perspective view of the motion pinball game, according to a preferred embodiment of the present invention.

Figure 2:
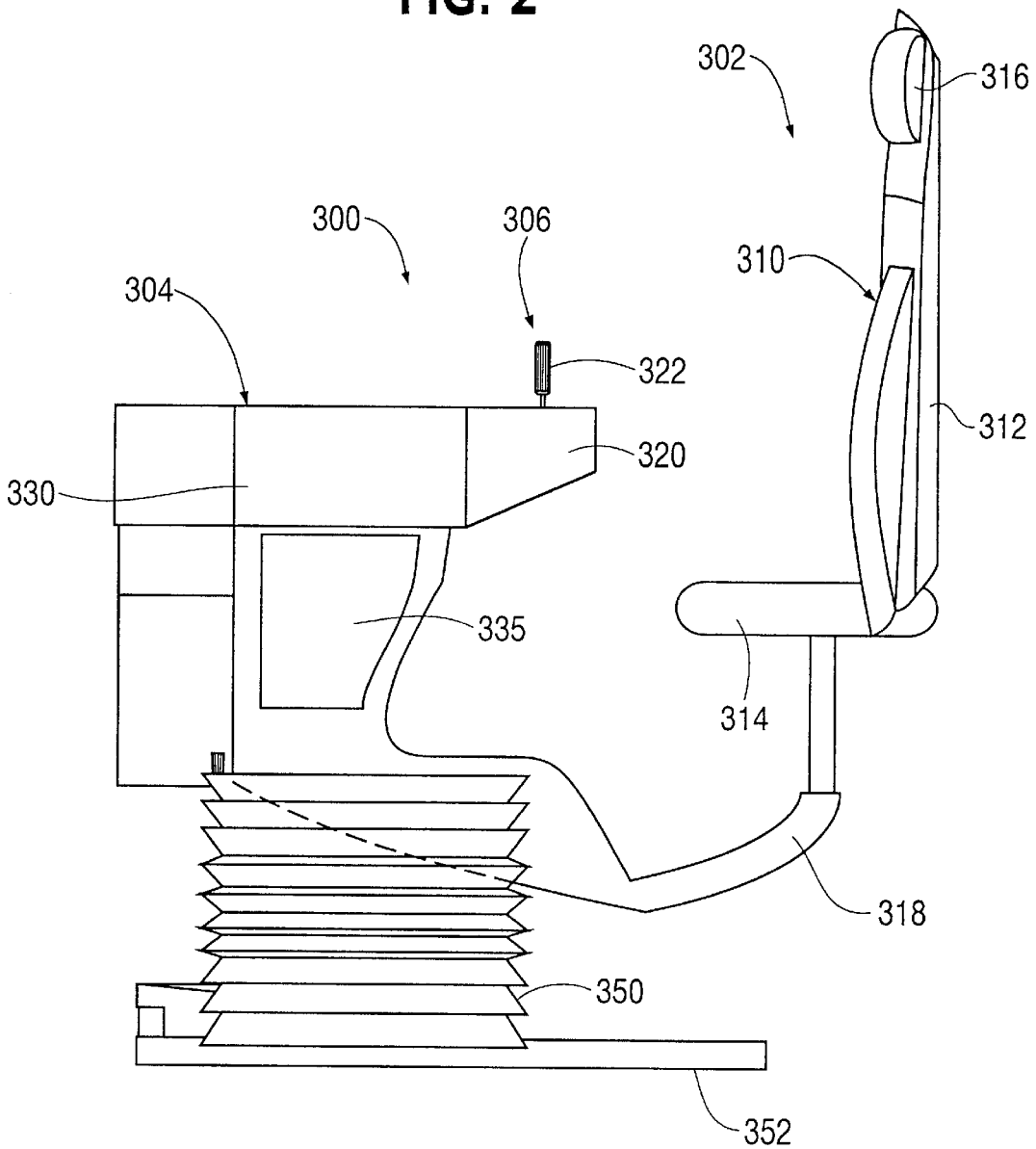
FIG. 2 is a side elevation view of the motion pinball game of FIG. 1.

FIGS. 1 and 2 show a motion pinball game 300 according to one embodiment of the present invention. Motion pinball game 300 includes a player station 302, a motion control interface 306, and a playing field portion 304. A player positioned in the player station 302 operates the pinball game by interacting with the motion control interface 306 to simultaneously move the playing field portion 304 and the player station 302 via power assisted motion. Power assisted motion allows the player to generate motion commands via a motion control interface that are received by and processed by a motorized motion platform. This design allows the player to control and experience the same motion as the playing field, which adds to the enjoyment of playing the game.

A pinball game base 350 can be coupled to a motion platform (described in detail below). Further, a base extension 352 can also be included to provide additional structural support when mounted to the motion platform. Various materials and specific shapes for the base 350 and the base extension 352 can be utilized, depending on the shape and size of the motion platform, as would be apparent to one of skill in the art given the present description. For example, base 350 can be a generally rectangular shape and can be made from aluminum, steel, stainless steel, or the like. Base extension 350 can also be a generally rectangular structure made from aluminum, steel, stainless steel, or the like.

Player station 302 is an area that a player can occupy and have access to the motion control interface and view the playing field in order to play the motion pinball game. Player station 302 can include an area where the player stands, sits, or kneels. According to a preferred embodiment, player station 302 comprises a seat 310 which includes a generally planar seat portion 314 and a back portion 312. The seat 310 can be cushioned for player comfort. A head rest portion 316 can also be included to provide additional comfort to the player. A leg rest area 313 can also be provided for further player comfort and/or support. Seat 310 can be made from conventional materials, preferably non-slip materials. For example, seat 310 can be made from plastic, leather, cloth, and other conventional synthetic materials. The seat 310 is coupled to base 350 via a seat support structure 318. In a preferred embodiment, seat support structure 318 comprises side panels 391 and 394, rear panel 393, front panel 392, and floor board 395. In a preferred aspect of this embodiment, floor board 395 can be configured (e.g., bent) to provide all or part of leg rest area 313. Support structure 318 can be of any design and should be of sufficient strength to support the weight of a normal human occupant undergoing approximately 3 g's of force during motion. In addition, a shoulder harness (not shown), such as a metal shoulder harness, canvass shoulder straps, a seat belt, and/or seat area siding can also be included in player station 302 to provide a safety restraint for the player while in motion, as would be apparent to one of skill in the art given the present description.

A playing field portion 304 comprises a playing field 305 that is mounted in a playing field enclosure 330. The playing field is any structure that contains an area for a playing ball to travel and can comprise any shape and have any arrangement of pins, holes, flippers, bumpers, and other conventional pinball game structures. The playing field enclosure 330 is coupled to base 350 via a playing field support structure 335. The playing field support structure 335 comprises side panels 396 and 398, rear panel 397, and front panel 399. In a preferred embodiment the seat support structure 318 and the playing field support structure 335 are formed as one contiguous support structure, as generally shown in FIG. 1. In a preferred embodiment, the seat support structure 318 and the playing field support structure 335 are made out of fiberglass. Alternatively, the seat support structure 318 and the playing field support structure 335 can be made out of laminated wood or thermoplastic.

During operation, a ball is released onto playing field 305 and its motion relative to the playing field can be controlled by the player. A glass or transparent plastic top piece (see top 331 in FIG. 4A) can be further included to prevent the ball from leaving the playing field portion 304. Playing field 305 can be fabricated from conventional materials, such as wood, plastic, fiberglass, and metal. In the embodiment shown in FIG. 1, playing field 305 has a hexagonal shape. Alternatively, playing field 305 can have a square, rectangular, circular, or other polygonal-type shape.

Motion pinball game 300 further includes a motion control interface 306. Motion control interface 306 allows the player to control the motion of the playing field portion 304 and the player station 302 by using powered motion with the aid of a motion platform. In a preferred embodiment, motion control interface 306 includes two joysticks 322, 324. Joysticks 322 and 324 provide motion control of the playing field and player station. Joysticks 322 and 324 can include one or more buttons or triggers which actuate flippers or other devices located in the playing field. In a preferred embodiment, a button 326 is located on a top portion of each joystick 322, 324.

In a preferred embodiment, motion pinball game 300 further includes a mounting panel 320 to which joysticks 322, 324 are mounted in a spaced apart relationship (i.e., spaced apart form each other) so that a player can balance her position in the player station 302 while undergoing motion. This spaced apart relationship is further described with respect to FIG. 4B. Alternatively, other gripping devices can be used for motion control, as would be apparent to one of skill in the art given the present description. In another alternative embodiment, a single joystick or gripping device can be utilized. In a further alternative embodiment, and as shown in FIG. 4C, mounting panel 320 can include a coin/token slot 352, which allows the player to pay a specific charge to play the pinball game, and a player selection unit 354, comprising a button or the like, which allows the player to select the number of players playing the game. The motion control interface 306 need not be restricted to placement on panel 320.

The player station 302, playing field region 304, and player motion control portion 306 can be assembled as a single unit, as shown in FIGS. 1 and 2. Alternatively, player station 302 and support structure 318 and playing field region 304 can each be of separate construction, each individually mounted to base 350.

Figure 3A:
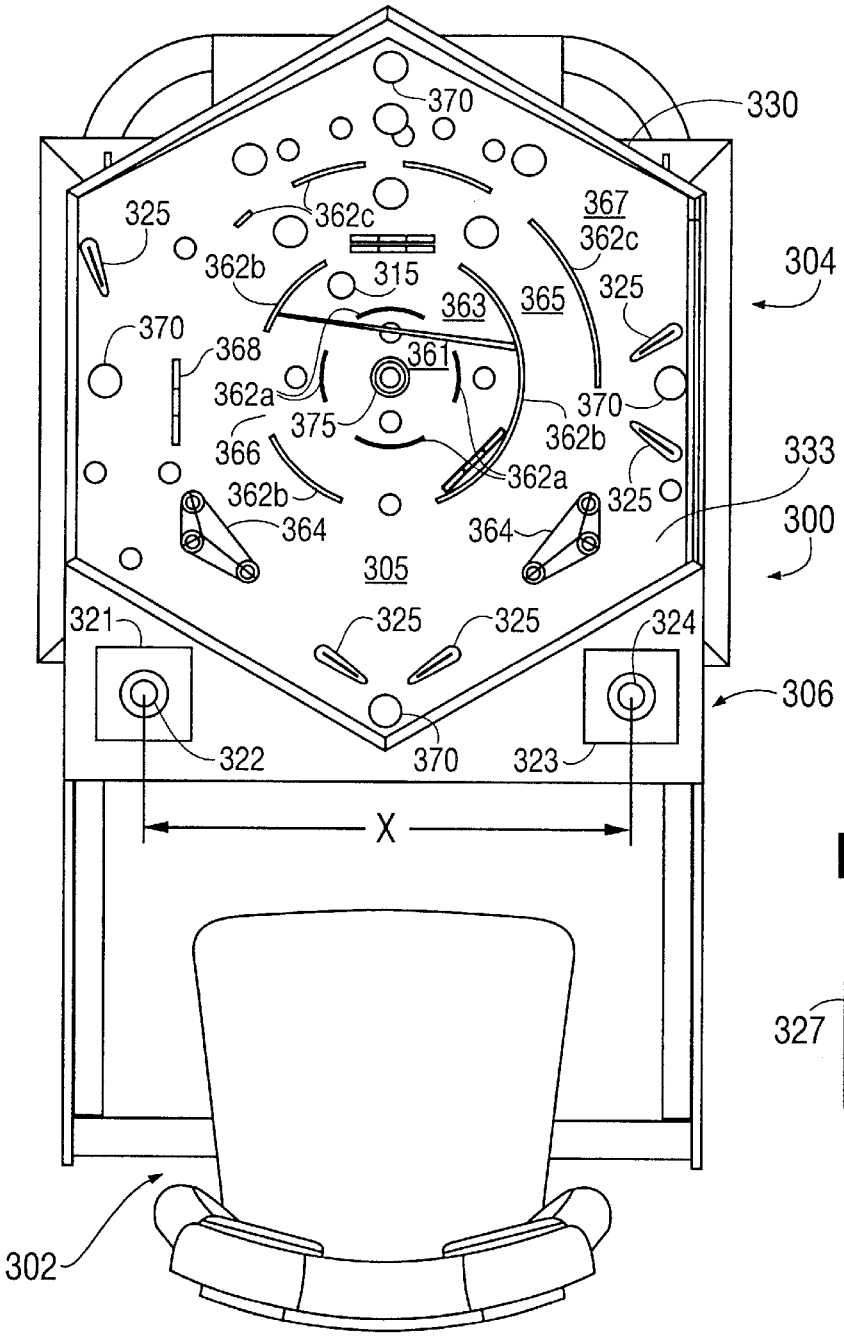
FIG. 3A is a top plan view of the motion pinball game of FIG. 1.

A top view of motion pinball game 300 is shown in FIG. 3A. Playing field portion 304 includes a hexagonal-shaped playing field 305 housed within playing field enclosure 330. According to one embodiment of the present invention, playing field 305 includes several scoring regions 361, 363, 365, and 367. In this embodiment, the scoring regions are arranged in a concentrically shaped pattern. For example, first scoring region 361 is located closest to center 375, second scoring region 363 is located next closest to center 375, and so on. Other arrangements of scoring regions are also contemplated, such as side-by-side, as would be apparent to one of skill in the art given the present description.

Each scoring region can be separated from its adjacent scoring regions by ridges 362 located on the top surface 333 of playing field 305. These ridges 362 are referred to as speed bumps, such as speed bumps 362*a*, 362*b*, and 362*c*. For example, speed bumps 362*b* separate second scoring region 363 from third scoring region 365. Various pathways created between and around obstacles, such as pathway 366, can also be located on playing field 305 to allow passage of the ball from one scoring region to the next. Obstacles located on the top surface of playing field can include holes 370, bumpers 364, walls 368, and other conventional pinball game scoring structures. Also, one or more conventional pinball flippers 325 can also be included on playing field 305. Further, as shown in FIG. 1, one or more of the interior walls of playing field enclosure 330, such as wall 355, con contain a scoreboard to inform a player or players of their respective scores and also indicate other scoring information. Also, the holes 370, bumpers 364, walls 368, and other conventional pinball game scoring structures of playing field 305 can each be coupled to one or more speakers mounted in the player station or on the playing field enclosure (not shown) that generate an audio response when contacted by the ball 315. Of course, as would be apparent to one of skill in the art given the present description, the specific design of playing field 305, including the position of scoring regions, numbers and types of obstacles, etc. can be altered, depending on the desired type of game and difficulty level sought.

Figure 4A:
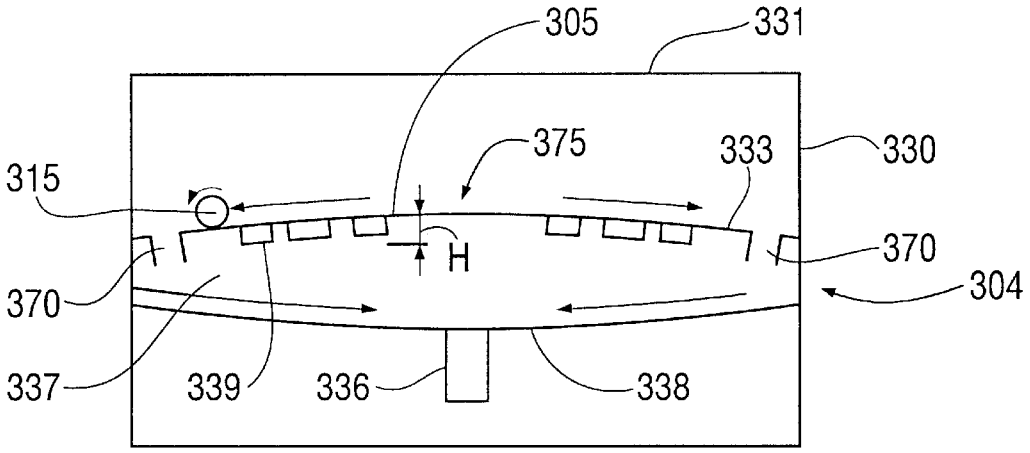
FIG. 4A is a side elevation view of the playing field according to another embodiment of the present invention.

Referring to FIG. 4A, a cross-section view of playing field portion 304 is shown. Playing field enclosure 330 further includes a top enclosure 331, which can be a glass, plexiglass, HEXAN, plastic material, or the like, that is transparent and is of sufficient strength and thickness not to break or crack when hit. Top enclosure can be of generally planar shape, or it can be dome-shaped. A preferred top enclosure material is tempered glass, having a thickness of about ¼ inch.

Playing field 305 has a top surface 333 that can be made from wood, metal, plastic, or like material. In a preferred embodiment, top surface 333 is a wood material that is coated with a conventional high strength varnish, that is of sufficient strength and durability to withstand multiple impacts over multiple uses from a playing ball, such as steel ball 315. Ball 315 can be of any practical size, with a conventional 1 inch diameter steel ball being preferred. Alternatively, ball 315 can be made from other conventional game ball materials, as would be apparent to one of skill in the art given the present description.

In addition, in a preferred embodiment, top surface 333 is smoothly crowned so that the surface slopes away from center 375. For example, the height of center of surface 333 can be raised at a height H, e.g., about 0.1 to about 0.5 inches, as compared to the height of the perimeter area of surface 333. With this design, a player must continue to move ball 315, or it will gravitate towards one of many collection holes 370 and end play for that round. On the underside of surface 333, various electronics, such as flipper control circuit 339, are coupled to various components on the top surface 333, such as flippers and bumpers. Other electronic components mounted to the underside of top surface 333 include solenoids, switches, counters, ratchets, motors, and lights.

FIG. 4A also shows a collection area 337, which is situated beneath top surface 333 and is used to collect ball 315 when the ball falls through a collection hole 370. Preferably, the collection area surface 338 is sloped to force a collected ball to move towards a ball release mechanism 336. The ball release mechanism 336 is utilized to release a ball into play when activated. The ball release mechanism is preferably a solenoid mechanism that lifts a collected ball onto the playing field. The ball 315 is set in motion when the joysticks are activated. The ball release mechanism 336 in this embodiment is positioned directly beneath playing field center 375, although it can be located at other positions as well. In addition, other ball release mechanisms can be utilized to introduce the ball 315 into additional locations in the playing field.

Figure 3B:
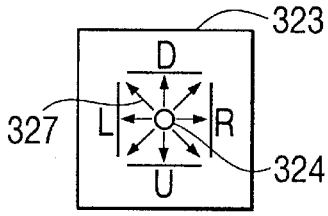
FIG. 3B is a top view of an eight-way joystick utilized as part of the motion control interface of FIG. 3A.

Referring back to FIG. 3A, a top view of motion control interface 306 is also shown. As described above, in this embodiment of the present invention, joysticks 322 and 324 can be utilized to provide motion control to the player. In other words, the motion control interface 306 allows the player to send motion command signals to the motion platform, which processes these command signals and generates motion of the playing field and player station. In this embodiment, joysticks 322 and 324 are coupled to conventional eight-way joystick switches 321 and 323, respectively. For example, as shown in FIG. 3B, eight-way joystick switch 323 comprises a four-switch arrangement, represented by individual switches labeled "D" (down), "R" (right), "U" (up), and "L" f (left), corresponding to the four main directions of motion of motion pinball game 300. In addition, when joystick is moved in a diagonal direction, for example, between D and L, as represented by arrow 327, both switches D and L will be actuated, thus signaling the motion control of the motion platform to move the motion pinball game accordingly. In a preferred embodiment of the present invention, these respective signals D, R, U, L, and diagonal combinations thereof, will be processed by the motion control platform into positive pitch, roll right, negative pitch, and roll left.

Figure 4B:
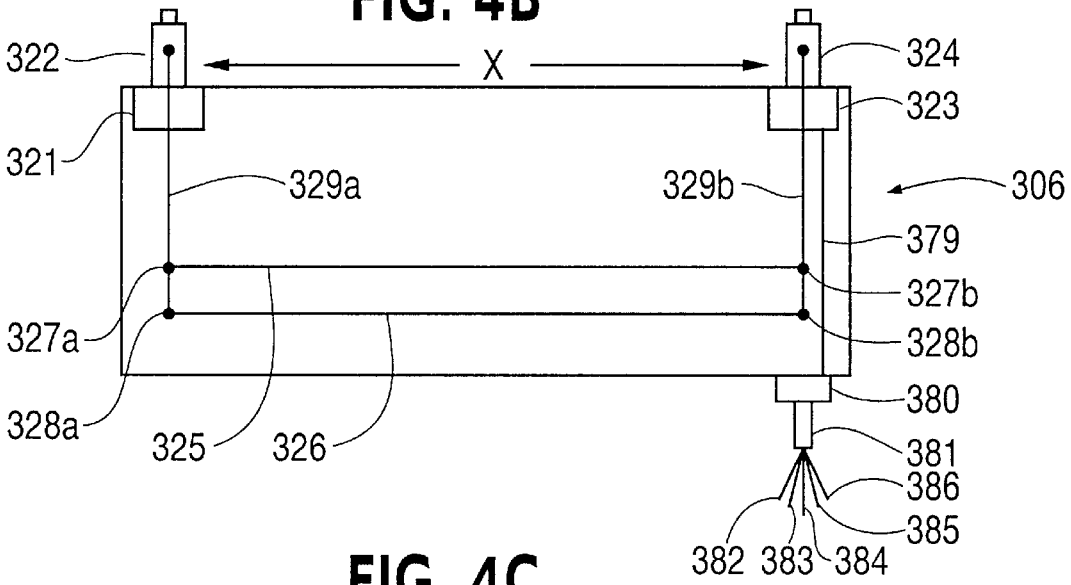
FIG. 4B is a side elevation view of the motion control interface field according to another embodiment of the present invention.
Figure 4C:
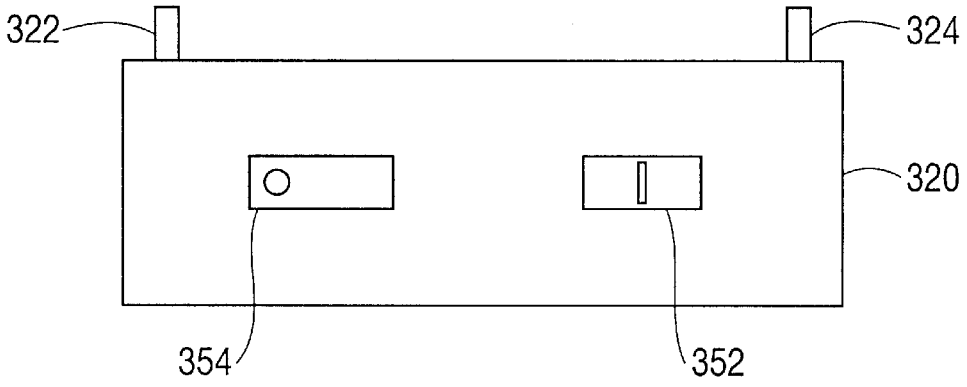
FIG. 4C is a front view of the motion control interface panel comprising a coin slot and a player selection button according to another embodiment of the present invention.

As shown in FIG. 4B, a cross section view of motion control interface 306, in a preferred embodiment, the movement of joysticks 322 and 324 is mechanically locked together by one or more bars, made from metal or other materials of similar strength. For example, FIG. 4B shows extension bars 329*a* and 329*b* respectively extending from joysticks 322*a* and 322*b*. A top metal bar 325 is coupled to each extension bar about two pivot points 327*a* and 327*b*, respectively. In this design, movement of joystick 324 is mechanically locked to the movement of joystick 322, and vice versa, so that both joysticks will move in an identical manner. This designs ensures that the motion platform will be guided in a manner that eliminates the occurrence of joysticks moving oppositely and canceling out intended motion while the player is jostled by the movement of the motion pinball game.

In addition, this design provides better gripping balance for the player. For example, in a preferred embodiment, joysticks 322 and 324 are laterally positioned a distance x from one another, where x corresponds to a distance of about 2 to about 4 feet (e.g., the shoulder width of an average adult), to give the player better balance under motion. Alternatively, a second metal bar 326, coupled to pivot points 328*a* and 328*b* can also be included to provide more enhanced structural integrity, giving the bar structure a parallelogram shape. Further, this design allows for the operation of a single switch 323 to signal proper motion control. In this embodiment, switch 321 can be a redundant or dummy switch that can be utilized in the situation where switch 323 fails or becomes faulty.

As discussed above with respect to a preferred embodiment, switch 323 generates a motion control signal responsive to the position of joystick 324. The motion control signal can be transmitted through a conduit 379 to a motion control interface output port 380. In this embodiment, cable 381 comprises wires 382 (F), 383 (R),

384 (B), 385 (L), and 386 (Gnd), which provide the motion control signal to the electrical control system of the motion platform (described below). Additional wires, such as for flippers and the like, can be coupled directly from the joysticks to the various components, such as flipper control circuit 339, located in the playing field portion 304.

In a preferred embodiment, game play takes place as follows. A player inserts a token or the proper coinage into the coin slot 352 to begin play. At this point a single player game or a multiple player game can be selected. In addition, a player can select a speed of the game, depending on the difficulty level desired. A ball is released onto the playing field 305 by the ball release mechanism 336 upon the player pressing a start button or after a predetermined period of time. The player moves the ball 315 relative to the playing field via motion control interface 306 by moving joysticks 322, 324 in a certain direction. The movement and acceleration of the game is initiated by the player moving the joystick and is controlled through the motion command software stored in the motion platform. Simultaneously, the player station 302 undergoes the same motion. In order to score points, the player moves the ball 315 relative to the playing field and hits scoring targets and bumpers with the ball 315. The player must generate sufficient ball speed so that the ball 315 can travel from one scoring region to the next across speed bumps (or through pathways) and hit scoring targets within different scoring regions. With this design, no runners or plastic troughs are necessary to direct the path of the ball in play. When the ball is captured by a hole and is collected, play for that round is completed and the player can then play the next ball. Alternatively, in a two player game, a second player enters the player station and begins play with her respective ball.

Figure 11:
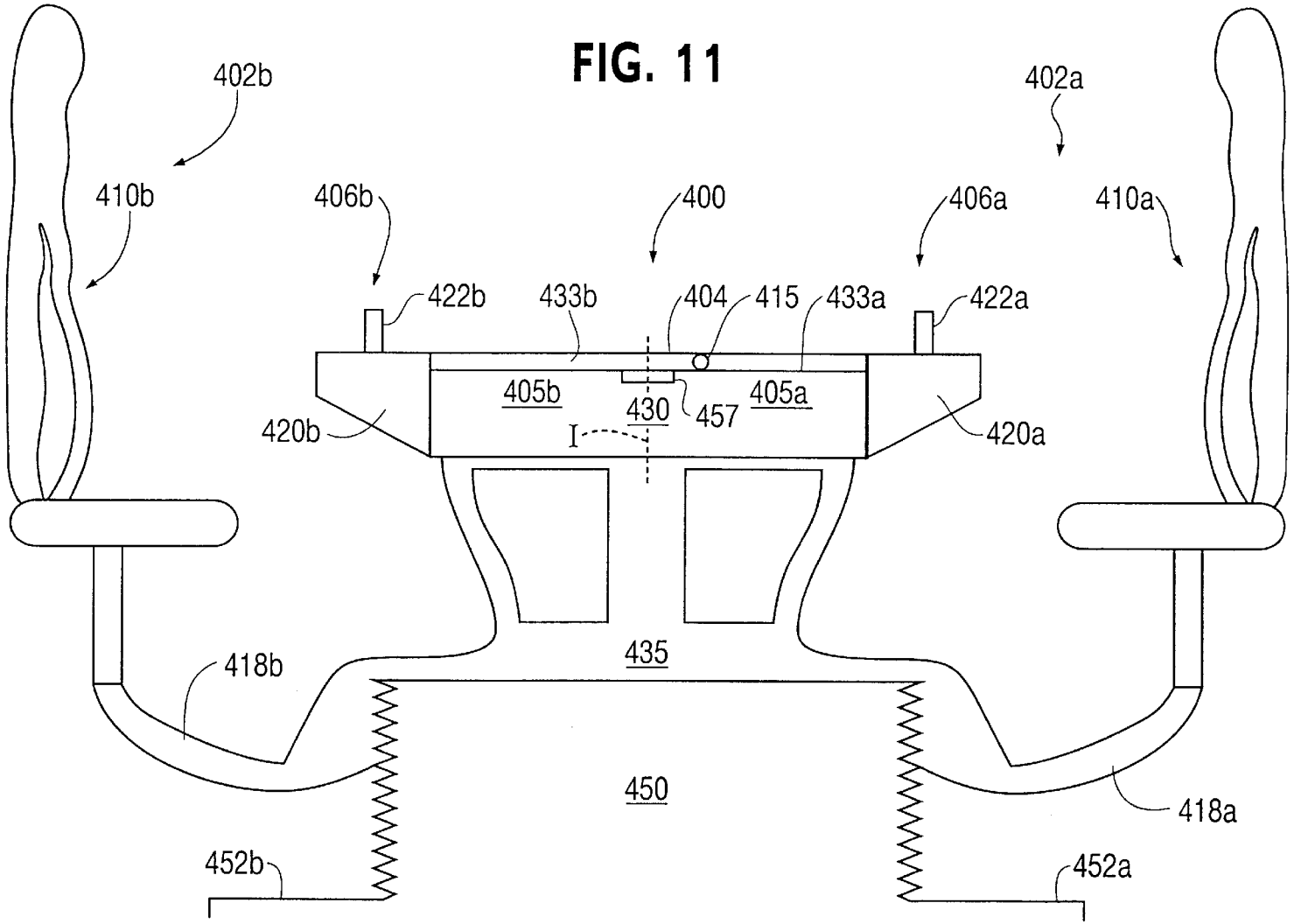
FIG. 11 shows a side view of an alternative embodiment of the present invention, a two player pinball game.

FIG. 11 shows an alternative embodiment of the present invention, a two player motion pinball game, where motion of the playing field and the player stations is controlled by either player, depending on the position of the ball on the playing field. Motion pinball game 400 comprises first player station 402*a*, second player station 402*b*, first player motion control interface 406*a*, second player motion control interface 406*b*, and playing field portion 404. Support structures 418*a*, 418*b*, and 435 respectively support seat 410*a*, seat 410*b*, and playing field 405, and are coupled to base 450. Base 450 and optionally base extensions 450*a* and 450*b* are mountable on a motion platform, such as motion platform 10, described with respect to FIG. 5. The aforementioned features of this embodiment are constructed in a similar fashion to those like features described above with respect to motion pinball game 300.

According to this alternative embodiment, a first player is positioned in player station 402*a* and a second player is positioned in player station 402*b*. The first player can generate a first motion control command signal via joystick 422*a*, mounted on panel 420*a*, and the second player can generate a second motion control command signal via joystick 422*b*, mounted on panel 420*b*. However, according to this embodiment of the present invention, only one of the players has actual control of the motion of the playing field and the player stations at any given time.

For example, in this embodiment, the playing field is separated into two main portions, playing field regions 405*a* and 405*b*, which respectively include a first playing field surface 433*a* and a second playing field surface 433*b*, where the portions are separated by a dividing line, labeled I. When a ball 415 is released onto the playing field region 405*a*, the first player has control of the motion of the playing field portion 404, and player stations 402*a* and 402*b*. A ball position sensor 457, which can comprise one or more sensors, such as magnetic Hall effect sensors, monitors the position of ball 415. When the ball 415 moves to playing field region 405*b*, the first player loses control of the motion control interface 406*a* (it is temporarily blocked from signaling the motion platform), and the second player, via motion control interface 402*b* obtains control of the motion of the playing field portion 404, and player stations 402*a* and 402*b*. Thus, depending on the position of the ball 415, either player has control of the motion of the pinball game at any given time. A winner can be determined by any number of ways, including scoring the most points in a particular region of the playing field surface. Alternatively, a series of goals can be arranged on the playing field surfaces 433*a* and 433*b* and the player with control of the motion can score in his opponent's goal, or vice versa.

According to an embodiment of the present invention, the motion pinball game can be mounted to a motion platform system, shown in FIGS. 5–10. While any motion conventional motion platform is contemplated, including those conventional motion platforms restricted to quadrature motion, a preferred motion platform is fully described in commonly owned, and co-pending U.S. patent application Se. No. 09/086,676, incorporated by reference herein in its entirety.

Figure 5:
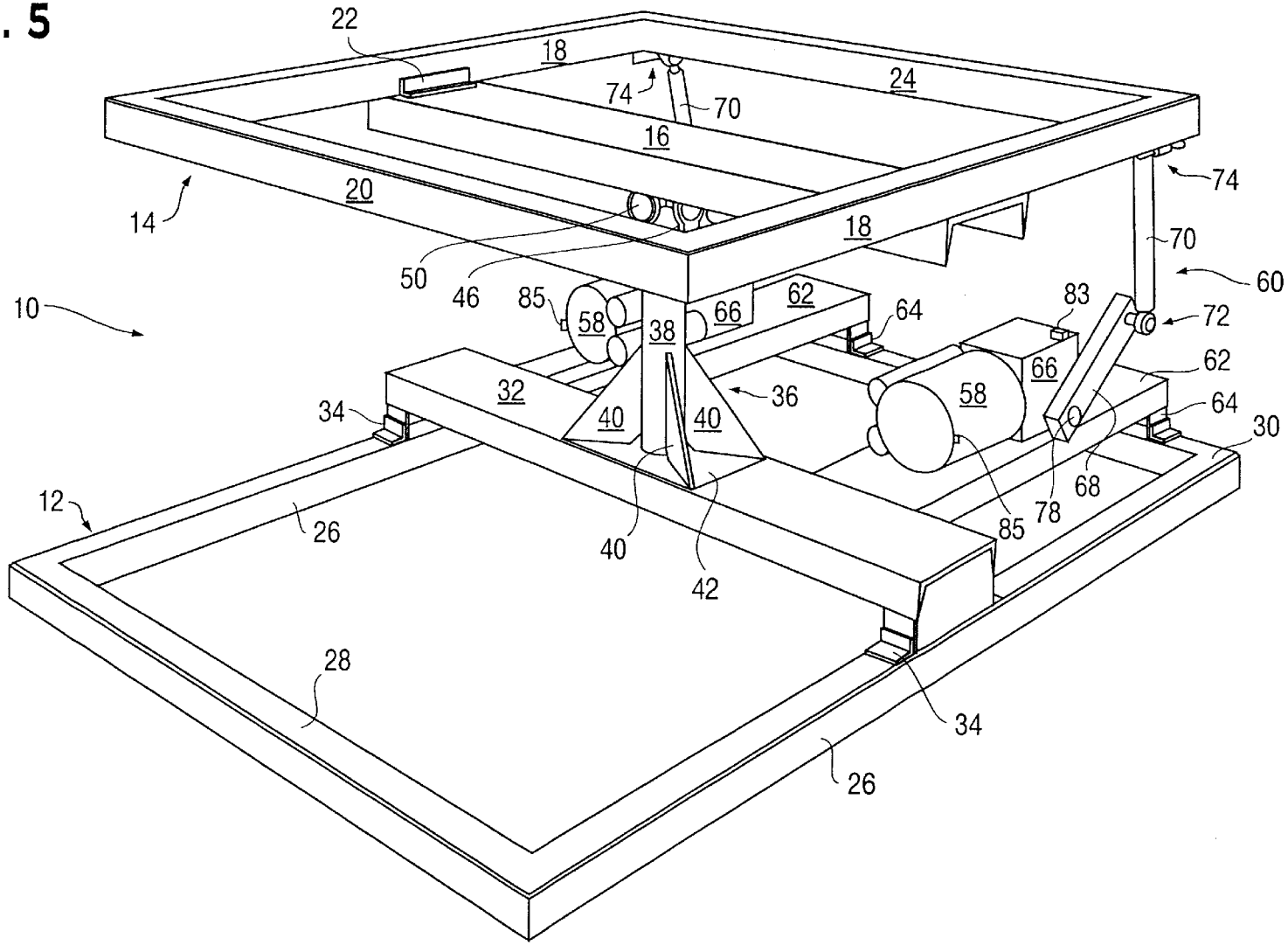
FIG. 5 is a perspective view of a preferred embodiment of a motion platform in accordance with a preferred embodiment the present invention.

By way of example, a preferred motion platform, generally indicated 10, is shown in FIG. 5. The motion platform 10 includes a base 12 and a top 14 for supporting a user module, such as motion pinball game 300 (shown in FIG. 1). The base 12 and the top 14 are generally rectangular. One of skill in the art, however, will readily recognize that either or both of the top and the base may have different cross-sectional shapes, such as circles, rectangles, hexagons and the like.

In a preferred embodiment, the shape of top 14 corresponds to the shape of pinball game base 350 (and base extension 352, if utilized). Thus, the pinball game base can be mounted onto top 14 in a conventional manner. Preferably, a motion pinball game is mounted to top 14 with a universal joint.

The top 14 and the base 12 preferably are formed from a single piece of metal, bent into the rectangular configuration shown in FIG. 5. The top 14 and the base 12 are preferably composed of an aluminum alloy, which reduces the overall weight of the motion platform relative to conventional motion platforms made of steel. Standard aluminum alloy, in standard mill sizes, provides an adequate strength-to-weight ratio, well above required safety limits for motion platforms. While weighing significantly less than steel and having excellent working characteristics, the aluminum design lends itself to automated manufacturing techniques required to produce large quantities and low cost. It will be understood, however, that the subject motion platform 10 may also be made of steel or any other material suited to the intended application.

The top 14 has a first beam 16 extending between two side arms 18 of the top 14. The motion pinball game is designed to be omni-directional to avoid any positional advantage for a particular player. In one aspect, when a motion pinball game is mounted on the motion platform 10, the first beam 16 may serve as a seat or seat support structure, with space for placement of a player's legs between the first beam 16 and a front arm 20 of the top 14. By positioning the seat close to ground level, the subject invention provides a platform that is easy for a user to enter and exit without the assistance of a trained operator. The first beam 16 is mounted to the side arms 18 by mounting brackets 22. The top 14 of the motion platform 10 is completed by a rear arm 24.

Figure 8:
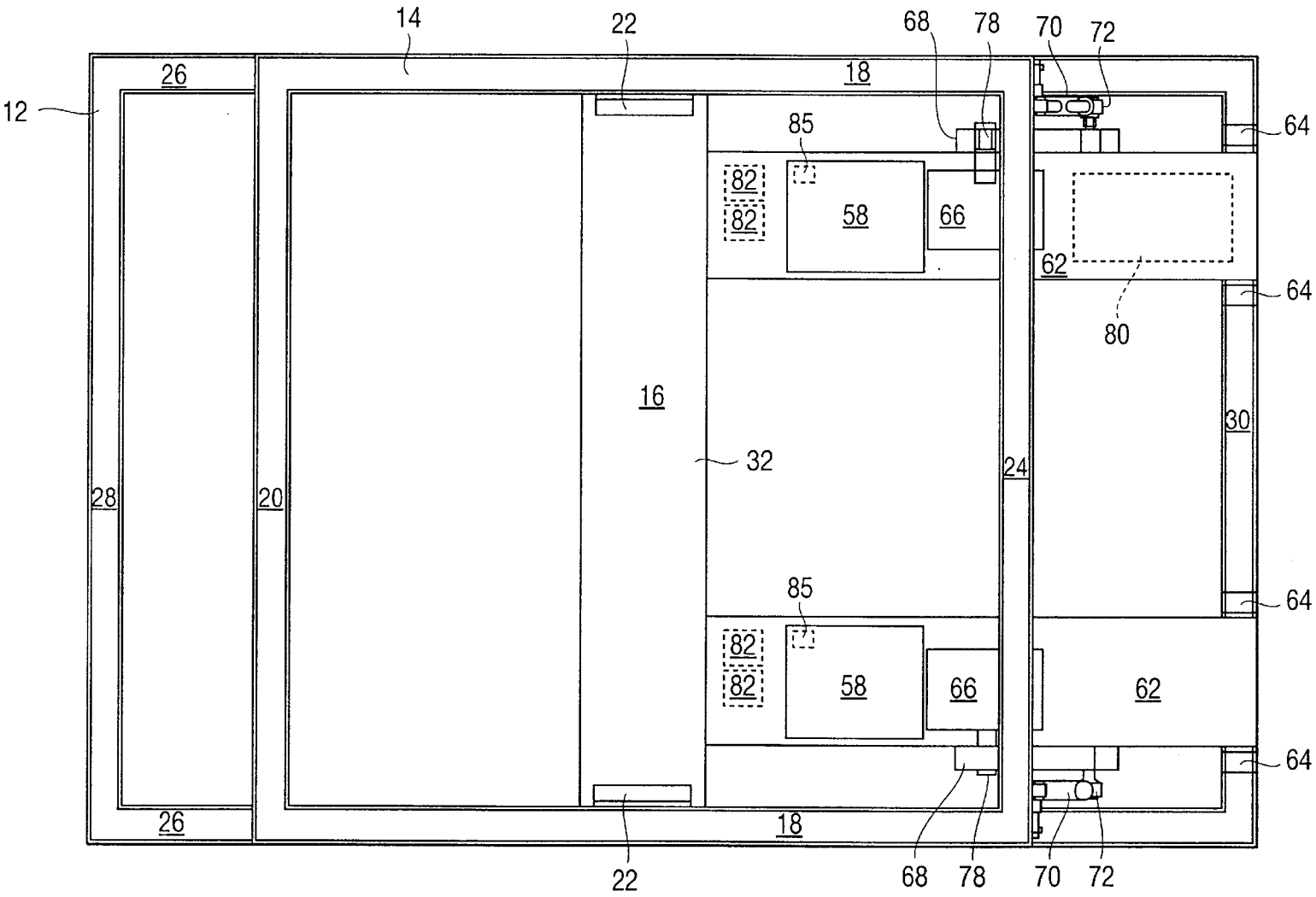
FIG. 8 is a top plan view of the motion platform of FIG. 5.

Like the top 14, the base 12 includes side arms 26, a front arm 28, and a rear arm 30. The perimeter of the base 12 bounds an area of generally larger cross-section than the perimeter of the top 14, as best seen in FIG. 8.

A second beam 32 extends between the two side arms 26 of the base 12. This second beam 32 is slightly elevated from the side arms 26 by stepped mounting brackets 34. These brackets may be standard mill-shaped, U-channel brackets.

A support member, generally indicated 36, supports the top 14 relative to the base 12. The support member 36 supports all of the weight of the top 14 and any attached motion pinball game. The support member 36 includes a hollow support beam 38, here shown as a cylindrical post, that vertically extends between a center of the first beam 16 and a center of the second beam 32. The support member 36 further includes fins 40 extending from an outer surface of the support beam 38 to the second beam 32. The fins 40 can attach either directly to the second beam 32 or, as shown in FIG. 5, to a plate 42 mounted on the second beam 32. The embodiment shown in FIG. 5 has four fins 40 extending to the four corners of the plate 42. The fins 40 reinforce the support beam 38. This reinforced support beam 38 provides maximum stiffness and strength to the motion platform and, in combination with a joint 44, discussed below, supports the load of the top 14 and any additional load, such as a motion pinball game.

Figure 6B:
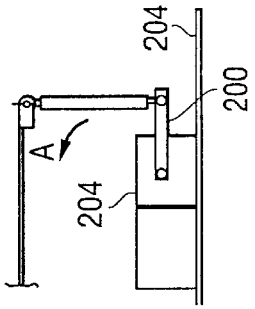
FIG. 6B (PRIOR ART)
FIG. 6B is a side elevation view of a motor and arm assembly of a motion platform restricted to quadrature motion.
Figure 6A:
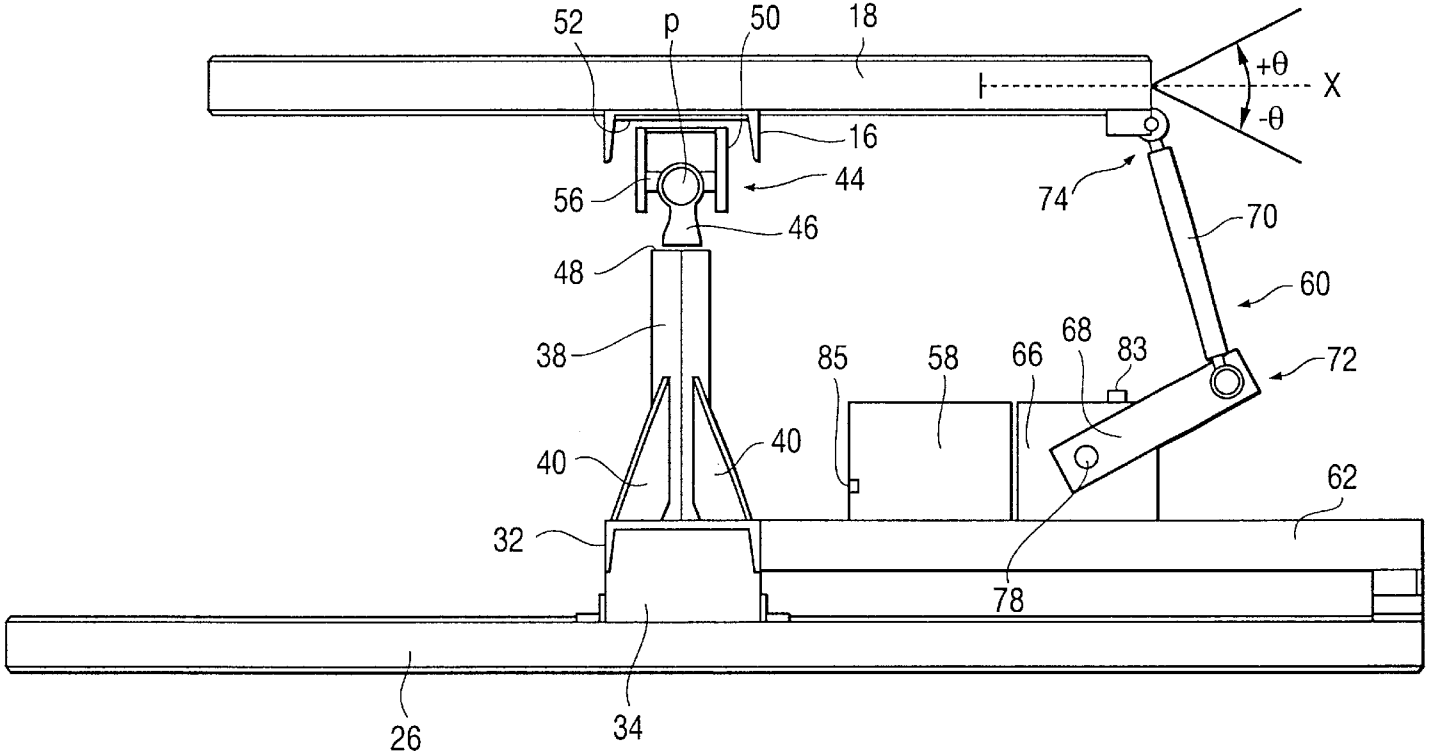
FIG. 6A is a side elevation view of the motion platform of FIG. 5.

As seen in FIG. 6A, a joint, generally indicated 44, is positioned between the support beam 38 and the first beam 16. The joint 44, which is preferably a heavy industrial universal joint or U-joint, allows a desired degree of pitch and roll of the top of up to ±35 degrees relative to the base. Preferably, for the motion pinball game, the degree of pitch and roll of the top is about ±20 degrees relative to the base, and can be limited by the motion control software. The joint 44 has a first fixed member 46 mounted to a top 48 of the support beam 32. The joint 44 slips inside the support beam 38 and is welded around its perimeter. The joint 44 also has a second fixed member 50 mounted to a bottom surface 52 of the first beam 16. First and second fixed members 46 and 50 are generally U-shaped and are oriented 90 degrees with respect to each other about a vertical axis. Interconnecting the distal ends of members 46 and 50 is a cross-shaped pivot member 56 which is rotatably mounted with respect to both members 46 and 50. The joint 44 provides pivot points P and P' that enable the top 14 to move in two degrees of freedom pivot relative to the support beam 38.

Figure 7:
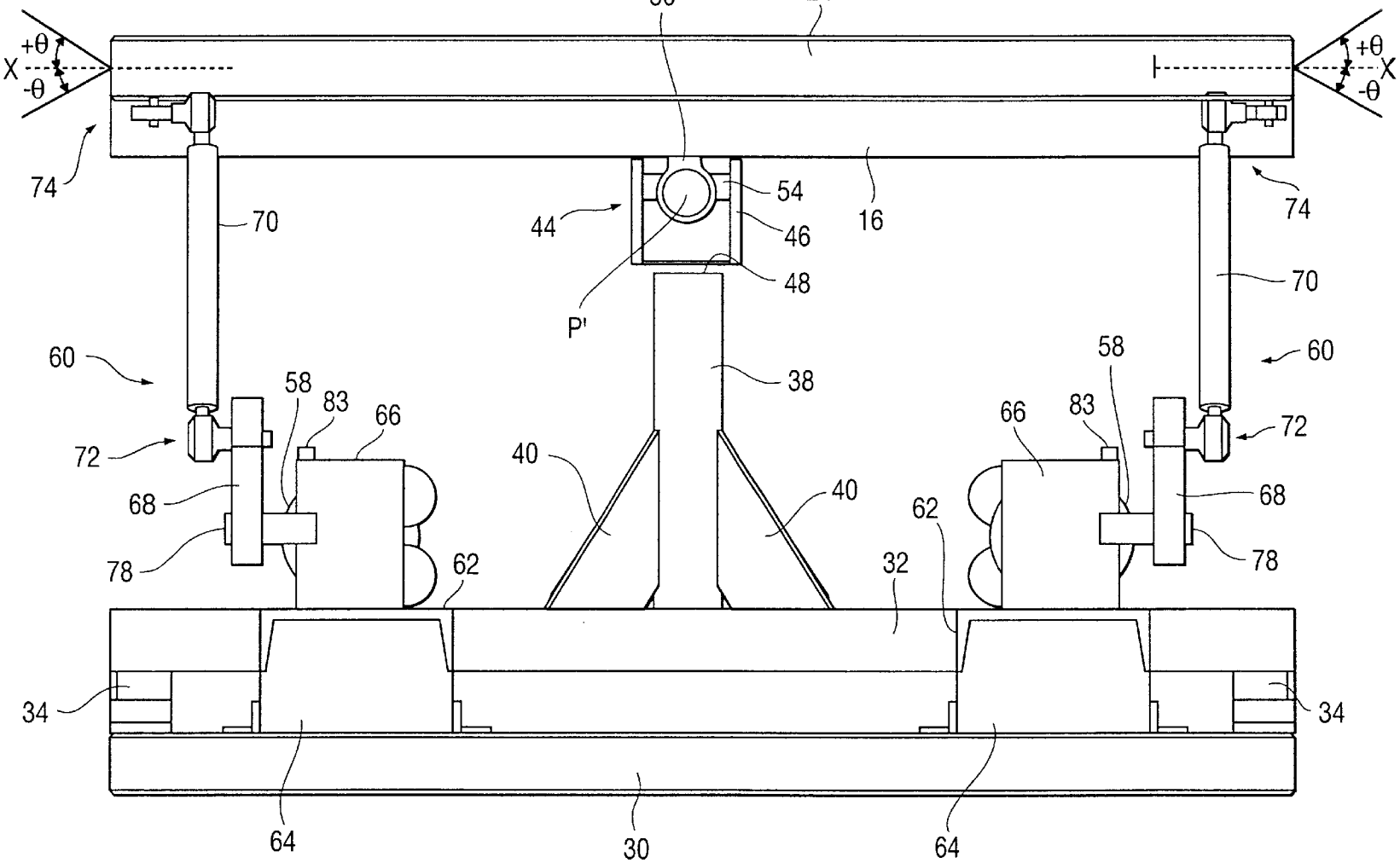
FIG. 7 is an elevation view of the motion platform of FIG. 5.

The motion platform also includes a pair of positioning motors 58 that rotate a pair of arm assemblies, generally indicated 60, to enable up to a ±35 degree range of motion of the top 14 relative to a horizontal plane shown as plane X in FIGS. 6A and 7. The pitch, or up/down, movement of the motion platform 10 is shown as $\pm\Theta$ in FIG. 6A. When the platform moves at a $+\Theta$ angle, the front arm 20 of the top 14 moves down. When the platform moves at a $-\Theta$ angle, the front arm 20 moves up. The angle $\Theta$ is also shown in FIG. 7 to show the range or extent of roll of the top 14 of the platform 10.

The positioning motors 58 are mounted on motor support beams 62, which in turn extend between the second beam 32 and the rear arm 30 of the base 12. The motor support beams 62 elevate the positioning motors 58 above the plane of the base 12. The motor support beams 62 are mounted to the rear arm 30 by stepped mounting brackets 64 and attach directly to the second beam 12.

The positioning motors 60 are high torque motors. They provide the rotary motion to rotate the arm assemblies 60. To achieve accurate positioning of the top 14 through rotation of the arm assemblies 60, the motors can be instantly reversed to provide braking or to provide reverse motion, as required.

The motion platform 10 further includes a reducer gear 66 coupled between each positioning motor 58 and its respective arm assembly 60. Like the positioning motors 58, the reducer gears 66 are mounted to the motor support beams 62. The reducer gears 66 have worm gear arrangements that reduce the speed of the positioning motors 58 to a desired rate. At the same time, because of the friction angle of the gearing, the reducer gears 66 provide braking to the arm assemblies 60 to prevent the top 14 from moving under changing loads at undesirable times.

Each arm assembly 60 includes a rotating arm 68 rotatably connected at one end to the output shaft of reducer gear 66 and thus to the positioning motor 58. The other end of the rotating arm 68 is rotatably connected to one end of a connecting arm 70 by a rotating ball joint, or rod end, 72. The other end of the connecting arm 70 is connected to a lower surface of the rear arm 24 of the top 14 by another rotating ball joint, or rod end, 74. The joints 72 and 74 operate so that the connecting arm 70 and the rotating arm 68 provide a rotating, variable angle joint to effect displacement of the top 14 and result in various combinations of pitch and roll during use of the motion platform 10. The dimensions of the arms 68 and 70 and the elevation of the positioning motor 58 and reducer gear 66 above ground level may be adjusted to control the maximum available pitch and roll angle.

The rotating arm 68 is rotatably connected to the output shaft of reducer gear 66 so as to be rotatable about the shaft axis a full 360 degrees. The ability of the rotating arm of platform 10 to rotate 360 degrees provides a wider range of motion, pitch and roll, for the motion platform 10 than possible in a conventional motion platform restricted to quadrature motion, as seen in FIG. 6B. In addition, the ability to rotate 360 degrees means that, in a single complete rotation of the motor, the platform "reverses" direction (goes from up-down to down-up), yet the motor need not reverse direction. Reversing the direction of the motor requires more work by the motor. The dimensions of the rotating arm 68 and the connecting arm 70 and the elevation of the positioning motor 58 above the base 12, in combination, enable this 360-degree rotation.

When the top 14 is in a level start position, as shown in FIG. 6A, the rotating arm 68 and the connecting arm 70 form an obtuse angle $\phi$. A benefit of a start position where the arms 68 and 70 form a non-right angle is that the positioning motors 58 are required to use less power to initiate rotational movement than those operating under quadrature motion (see FIG. 6B). As a result, the motion platform 10 may be run with smaller, and hence, more compact, lighter and inexpensive motors 58.

In a conventional motion platform, such as shown in FIG. 6B, the linkage between the motor and the platform top is at a 90-degree angle at the start position, and thus motor must initiate movement when it is at its highest load. However, as mentioned above, and in accordance with an alternative embodiment of the present invention, the motion pinball game base (and base extension, if utilized) can be mounted to a motion platform restricted to quadrature motion.

The connecting arm 70 enables static alignment of the motion platform 10. The connecting arm 70 is hollow and has threaded ends, which connect respectively to the rotating ball joints or rod ends 72 and 74. Thus, the length of connecting arm 70 may be readily adjusted by threading either or both of the joints 72 and 74 into or out of the arm until the top 14 is in the desired position relative to base 12. In this manner, the connecting arm 70 may be used to align/level the motion platform 10.

The positioning motors 58 operate independently. In this way, the positioning motors 58 cause rotation of their respective rotating arms 68 to achieve whatever desired pitch, roll motion or vibration effects are desired.

The control system for the motion platform 10 will now be described in conjunction with FIGS. 7, 8 and 9. A microcontroller 80 is mounted to a lower surface of one of the motor support beams 62. The microcontroller 80 controls all functionality of the motion platform 10. Also mounted to the lower surface of the motion support beams 62 are four solid state relay and delay circuits 82, which will be referred to as relays 82, mounted two on each beam 62. These pairs of relays 82 are electrically connected to the microcontroller 80 and to each of the respective positioning motors 58. The relays 82 allow relatively instantaneous reversal of direction and control of rotation of the positioning motors 58.

The motion platform 10 further includes sensors. The sensors preferably are infrared emitting LEDs and photo-transistors. First sensors 83 are mounted to a top surface of each of the reducer gears 66 to sense a position of a respective rotating arm 68. The first sensors 83 detect when the position of the respective rotating arms 68 are in the home position, as shown in FIG. 6A. Light is reflected onto the respective sensor 83 from the rotating arm 68 as the rotating arm enters the home position. Second sensors 85 are mounted to the positioning motors 58. The positioning motors 58 may comprise A/C motors or DC motors, both of which have cooling fans with equally spaced blades. Each of the second sensors 85 senses the passage of an edge of each fan blades as that edge passes in front of the sensor 85.

The microcontroller 80 is responsive to digital input commands and to feedback signals generated by both sets of sensors 83 and 85. The microcontroller controls the start/stop, rotational direction, rotational speed and vibration of the positioning motors 58 in response to the input command signals supplied to the microcontroller 80 and the position, speed and extent of movement information provided by the sensors 83 and 85, as will be fully described below.

Figure 9:
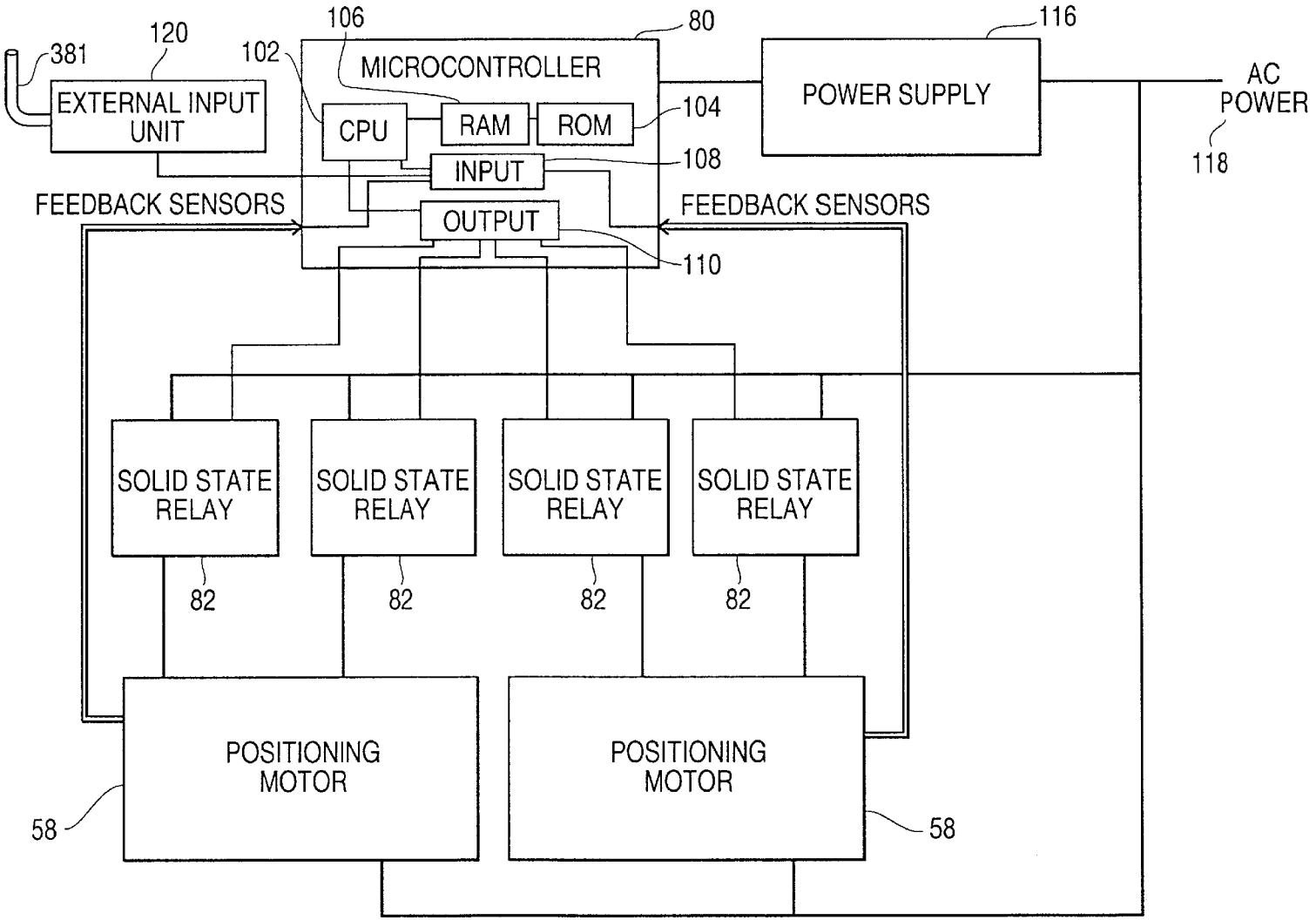
FIG. 9 is a block diagram illustrating the microcontroller and electrical system of the motion platform in accordance with a preferred embodiment of the present invention.

FIG. 9 is a block diagram of the electrical control system of the motion platform 10 of the present invention. The microcontroller 80 includes a central processing unit (CPU) 102, storage in the form of ROM 104 and RAM 106, an input interface 108, and an output interface 110. The CPU 102 is preferably an 8-bit microcomputer optimized for real-time control applications. RAM 106 serves as temporary storage, and ROM 104 stores programming associated with operation of the motion platform 10 related to the motion control signals generated at the motion control interface, such as the programming associated with the flowcharts shown in FIGS. 10A–10E. The input interface 108 receives signals from sensors 82 that sense the position of the rotating arm 68 and the passage of the fan blades of the positioning motors 58, as described above. The input interface 108 transmits these sensor signals to the CPU 102 for processing. The CPU 102 sends processed signals to the output interface 110, which outputs signals to the solid state relays to drive the positioning motors 58, as desired. The microcontroller 100, through its output lines, controls the ON/OFF state and speed and direction of rotation of the positioning motors 114 based on sensor signals input into the microcontroller 100.

The relays 82 switch the positioning motors 114 ON and OFF at a rapid rate which is fast enough to control both the speed and the degree of rotation of the positioning motors 114. If it is desired to operate the motors 58 at full speed, for example, the relays 82 are turned on and kept on without interruption. If a reduced speed is desired, the relays 82 are switched on and off to supply the motors with an interrupted or pulsed input voltage. The lower the frequency of the pulse train, the slower the speed of the motor and vice-versa. In this way, by controlling the cycle of the relays 82, the motor speed is directly regulated. Similarly, by controlling the polarity of the motor input signal through the relays, the direction of rotation may be controlled. Finally, by combining control of the direction and speed signals fed to the relays 82, the motors can be caused to move in a stepwise or interrupted manner at any desired rate or degree, thereby imparting any number of desired vibration effects to the top 14 of the platform 10.

The motion platform 10 also includes a power supply 116 adapted to be connected to a suitable A/C power source 118 to provide power to the microcontroller 80.

The motion platform 10 is adapted to receive motion signals from a motion control interface via a motion control interface cable 381 and/or an external command signal input unit 120, which may or may not be further coupled to a computer terminal or other ascii device capable of transmitting and receiving ascii characters, that electrically communicates with the CPU 102 through the interface input unit 108. Operational commands may be supplied through the input source 120 in accordance with player-originated motion control to produce a pattern of movement of the top 14, which is coupled to base 350 of motion pinball game 300, relative to base 12. Such data and operational commands can include: straight and level (H), pitch angle positive (P), pitch angle negative (N), acceleration (A), roll angle right (R), roll angle left (L), set speed (SP and SR) for each motor, set vibration (VP and VR) for each motor, status (Q), and ON/OFF (T). Thus, according to a preferred embodiment of the present invention, the actual game play is controlled by a computer, here microcontroller 80, which generates the motion commands based on the motion signals initiated by the motion control interface.

The motion platform can receive all its commands from the external input unit 120. As in the preferred embodiment, the motion platform 10 is used as part of a motion pinball game, where the external input unit 120 receives signals via cable 381 from the motion control interface 306 operated by a player, which produces signals recognizable by the microcontroller's CPU 102. In an alternative embodiment, the microcontroller receives command signals directly from the motion control interface 306.

The microcontroller 100 processes motion signals and it can sense what movement of the platform has undergone. As mentioned above, the receipt of input motion signals from the motion control interface an/or external input unit 120 is recognized by input interface 108 and CPU 102 of the microcontroller 80. Sensing of the movement the platform has undergone is provided by sensors 83 and 85. Sensors 83 each produce a pulse when a fan blade of the motor passes within proximity of the sensor. The number of pulses indicates the amount of rotation of the motor shaft and, thus, the extent of movement of the connecting arm assembly 60. The frequency of the pulses indicates motor speed. Thus, by detecting and counting the pulses from sensors 83, the microcontroller can recognize the speed and extent of movement of each motor and can compute the nature and degree of motion undergone by top 14 relative to base 12.

The essential control sequences performed by microcontroller 80 are shown in FIGS. 10A–10E. As a first step, a power-on initialization procedure is performed in accordance with the flow diagram of FIG. 10A. The initialization procedure ensures that the motion platform 10 is level and that the microcontroller 80 is ready to receive interrupts from other control routines. In step 200 of this procedure, the power source 116 of motion platform 10 is turned ON. With the power ON, commands are sent by the CPU through the output interface 110 to the relays 82 of motors 58. This causes the motors 58 to move, causing the rotating arms 68 to move past their respective arm position sensors 83. The microcontroller detects the signal indicating passage of the arm through this "zero set" position and then begins to count the pulses from the motor fan blade sensor 85. When the predetermined number of pulses has been received to indicate that the arm has been moved to the "home" position corresponding to the level or horizontal orientation of the top 14, all other interrupts are initialized, as represented by step 204, and the motor and CPU are placed in the halt mode 206. In halt mode 206, the power to the system is ON, the top of the platform is steady and level, and the system is ready to receive motion commands.

Figure 10A:
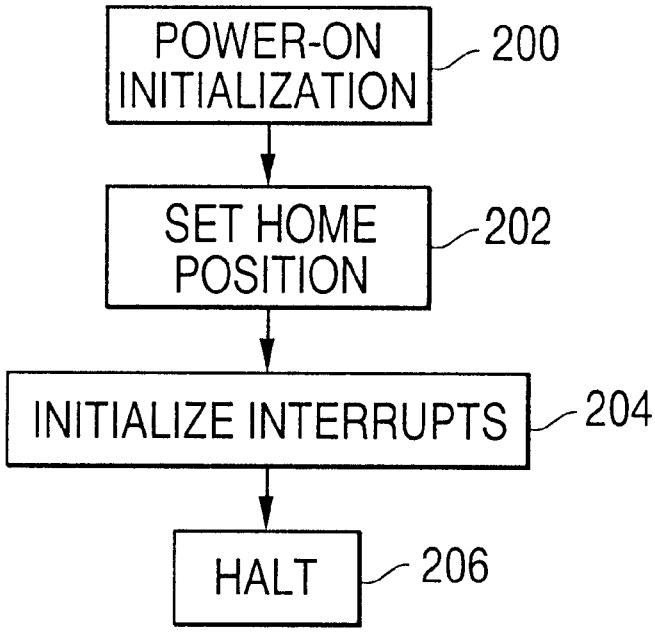
FIGS. 10A through 10E are program flow charts of the microcontroller program which controls operation of the motion platform in accordance with a preferred embodiment of the present invention.
Figure 10E:
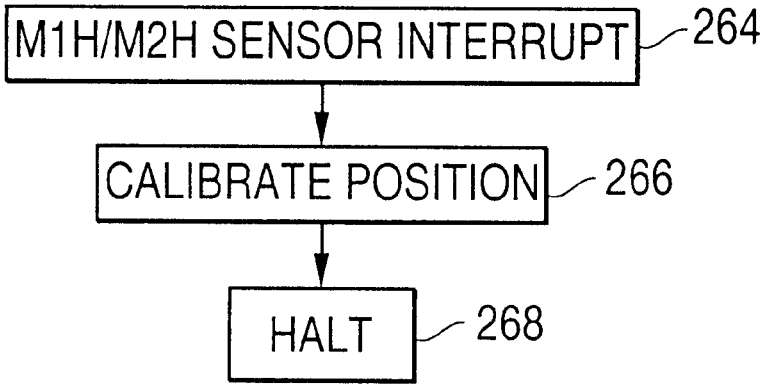
Figure 10B:
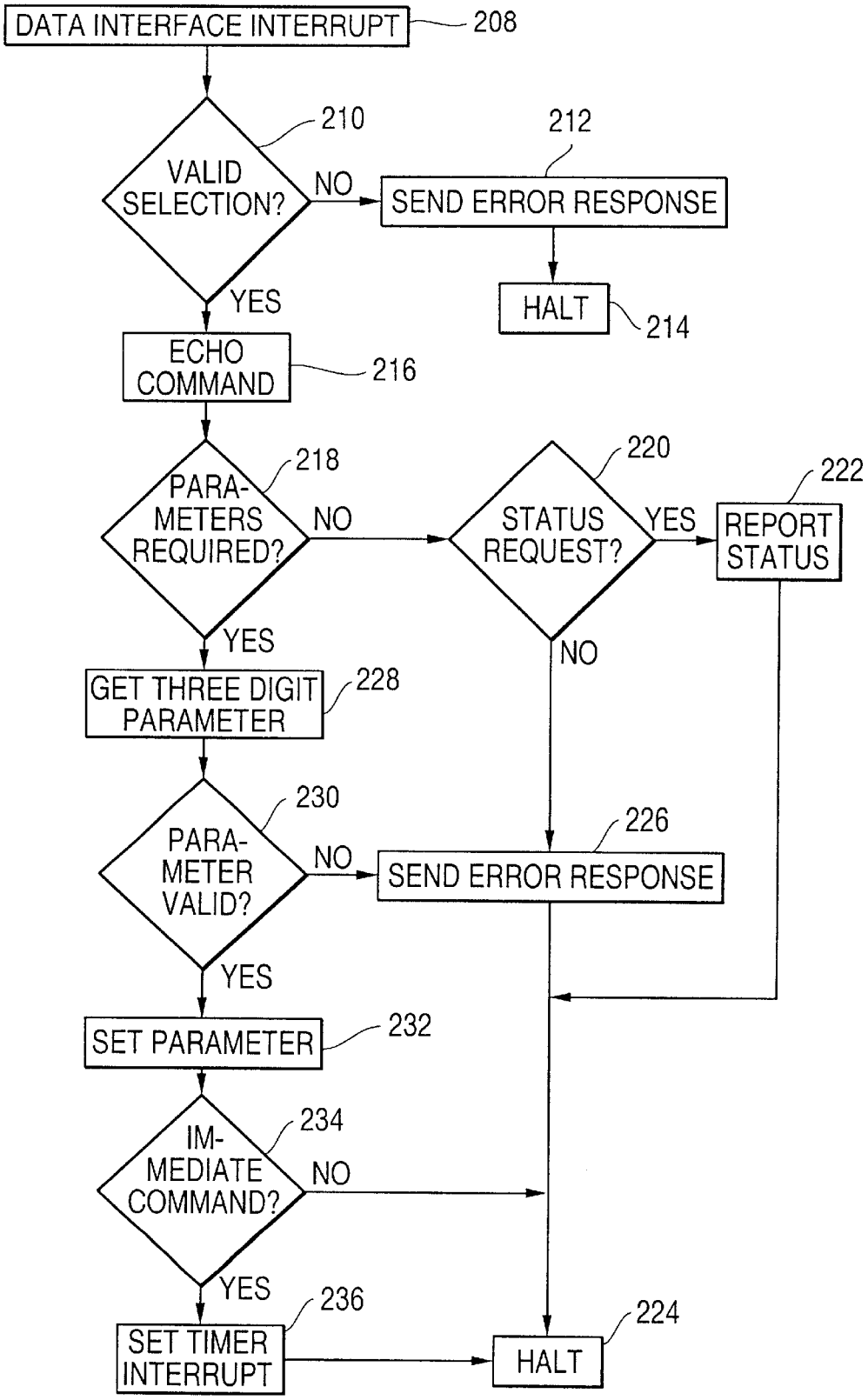

FIG. 10B illustrates the data interface interrupt sequence, which is the primary control sequence or loop for the system in accordance with the present invention.

A data interface interrupt 208 will occur when the CPU 102 receives data or character input signals from motion control interface 306 or the external control unit 120. Initially, in step 210, the data interface interrupt queries whether the CPU 102 has received a valid command or input signal from the motion control interface 306 or external input unit 120 that corresponds to built in parameters stored in RAM 106. As stated above, these commands include home-straight and level (H), pitch angle positive (P), pitch angle negative (N), acceleration (A), roll angle right (R), roll angle left (L), set speed (SP and SR) for each motor, set vibration (VP and VR) of each motor, status (Q), and ON/OFF (T). If the answer to this query is NO, then the CPU 102 sends an error response in step 212, and the loop halts in step 214. If the CPU 102 has received a valid command, then the command is echoed in step 216. The loop then queries in step 218 whether additional ascii characters representing parameters of the command are required. For example, if a set speed command SP or SR is received, the system will need to know what particular speed is desired. The system is programmed to recognize a three-digit numerical value from 0 to 999 to indicate a desired speed from zero to the maximum speed of the motors 58. While a three digit numerical value in the range of 0 to 999 has been selected in the present preferred embodiment, it should be appreciated that a lesser or greater range, with fewer or greater numbers could be implemented to accommodate the requirements of a particular application, depending upon the degree of accuracy and control desired.

If the echoed command does not require any additional parameters, then the interrupt answers NO and proceeds to step 220. Here, the CPU 102 conducts a status request, checking to verify that the command corresponds to a status command, namely H, Q, or T, each of which require only a single command without further specifying parameters. If the response to the status request is YES, then, in step 222, the CPU 102 reports the status and proceeds to a halt mode in step 224. If, on the other hand, the response to the status request query is NO, then, in step 226, an error response is sent before proceeding to a halt in step 224.

If, in step 218, a parameters requirement is recognized, then a retrieve sequence is initiated in step 228 to get the complete parameter from the CPU. The CPU 102 then checks to see if the retrieved parameter is valid in step 230. For example, if the system is set to look for a numerical value between 0 and 999, a valid parameter would be any number in that range. If the answer is NO, then an error response is sent in step 226, and the loop is halted in step 224. If the parameter is valid, however, the parameter is set in step 232.

The CPU 102 then checks for an immediate command in step 234. The immediate commands require action or movement of the platform and include commands P, N, R, and L. If the command is not an immediate command, then the interrupt loop is again halted at step 224. If an immediate command is detected, then the timer interrupt is set in step 236, and, thereafter, the loop is halted in step 224.

Figure 10C:
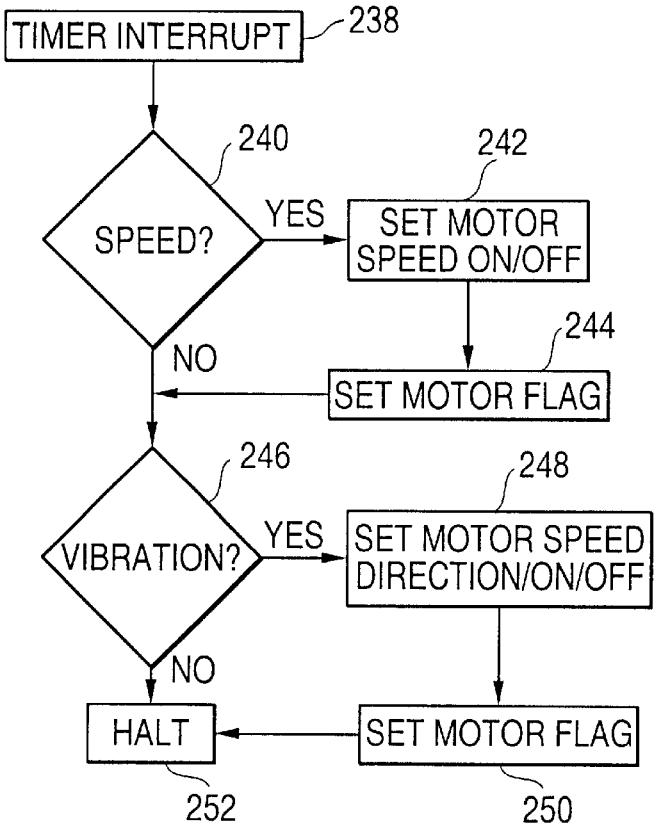

Since all of the parameters which call for an immediate command cause the motor/s to move some amount in a forward or reverse direction, the timer interrupt routine, shown in FIG. 10C, is used to set the motor/s speed/direction/ON-OFF status, according to commands in the form of data signals received from the motion control interface 306 or external input unit 120. In the timer interrupt routine, begun at step 238, a speed inquiry is first performed in step 240. If this speed inquiry response is YES, then the motor speed is set in step 242, and a motor flag is generated in step 244 to indicate to the CPU what the motor is doing. The program then continues to perform a vibration inquiry in step 246. If the response to the speed inquiry in step 240 is NO, the program proceeds directly to the vibration inquiry in step 246.

If the response to the vibration inquiry is YES in step 246, then a motor Speed/Direction ON/OFF command is produced in step 248, and a motor flag is generated in step 250 to indicate what the motor is doing. The program then proceeds to a halt in step 252 to await the next interrupt.

Figure 10D:
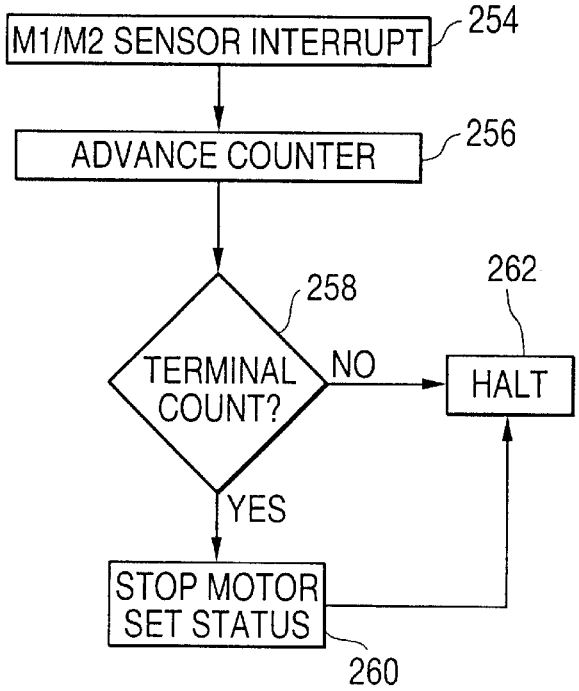

The microcontroller 102 also runs an M1/M2 (first motor/second motor) sensor interrupt routine, as shown in FIG. 10D. This routine monitors the second sensors 85 that detect passage of the fan blades of the positioning motors 58. The pulse count and pulse frequency provide extent of motion and speed information to the CPU, as described above.

In step 256, a counter in the CPU 102 is advanced when the sensor detects passage of a fan blade. At each count of the counter, the routine inquires whether a preprogrammed terminal count has been reached at step 258. The preprogrammed terminal count is determined based on how many revolution of the positioning motor are desired to move the rotating arm into the correct position to achieve the desired pitch angle or roll angle of the top of the motion platform. Once the terminal count has been reached, the routine proceeds to step 260 where the motor is stopped, and the motor status is set. Then the routine proceeds to a halt status in step 262. If the terminal count has not been reached at step 258, then the routine proceeds directly to the halt status in step 262.

To assure that proper synchronization of the system is maintained, the microcontroller 100 also runs a M1H/M2H sensor interrupt routine, as shown in FIG. 10E. This sequence is based on the recognition of the fact that a single shaft rotation of each of the motors 58 is integrally related to rotation of each of the connecting arms 68. Thus, if the motor fan contains twelve blades, as is quite common, twelve pulses of sensor 85 will signal one rotation of the motor shaft. From this, it can be appreciated that for each rotation of the arm 68, and then for each pulse of sensor 83, the number of pulses from the motor fan blade must be an even multiple of twelve. If the fan blade pulse count is not an integral multiple of twelve, the system will recognize that it is out of synchronism and the counters must be reset to re-calibrate the system.

The M1H/M2H sensor interrupt sequence of FIG. 10E accomplishes such recalibration on initiation of the interrupt at step 264, performing a modulus twelve comparison of the counts of sensors 83 and 85, as described above, and resetting the sensor counts when necessary in step 266 before returning to a sequence halt mode in step 268.

The microcontroller 100 is thus able to control pitch, roll, speed and vibration movements of the motion platform 10 reliably, economically and efficiently. The motion platform is therefore uniquely adaptable to the motion pinball game described herein.

Additional advantages and modifications will readily occur to those skilled in the art. Therefore, the invention in its broader aspects is not limited to the specific details, and representative devices, shown and described herein. Accordingly, various modifications may be made without departing from the scope of the general inventive concept as defined by the appended claims.

What is claimed is:

1. A motion pinball game, comprising:

a player station;

a playing field;

a motion control interface; and a motion platform moveable upon receipt of a motion command, wherein said player station and said playing field are coupled to the motion platform, and wherein said motion platform is responsive to a motion control signal generated by said motion control interface.

2. The motion pinball game according to claim 1, wherein the player station and playing field are coupled to a pinball game base, and wherein said motion platform comprises:

a motion platform base;

a top upon which said pinball game base is mounted;

a support member for supporting the top relative to the motion platform base with freedom of movement about at least one horizontal axis;

a pair of positioning motor assemblies mounted to said motion platform base;

an arm assembly extending between each of said positioning motor assemblies and said top, said arm assembly being responsive to rotary motion of a respective one of said positioning motor assemblies and adapted to rotate 360 degrees about said respective positioning motor assembly to effect relative movement of said top about said at least one axis; and a microcontroller coupled to the motion control interface and electrically connected to said positioning motor assemblies for controlling a rotational speed and a rotational direction of said positioning motor assemblies and thus angular displacement of said top of said motion platform.

3. The motion pinball game according to claim 2, wherein said arm assembly displaces said top of said motion platform where said arm assembly connects to said motion platform up to ±20 degrees from an imaginary plane level with a ground surface.

4. The motion pinball game according to claim 1, wherein said player station and said playing field are constructed as a contiguous unit.

5. The motion pinball game according to claim 1, wherein said motion control interface includes as joystick.

6. The motion pinball game according to claim 5 comprising two joysticks, wherein a movement of a first joystick is mechanically locked to a movement of a second joystick.

7. The motion pinball game according to claim 6, further comprising:

a first extension bar extending from said first joystick;

a second extension bar extending from said second joystick; and a bar pivotally coupled to said first and second joysticks.

8. The motion pinball game according to claim 1, wherein said playing field comprises:

a playing field enclosure, a first playing field surface, and a ball.

9. The motion pinball game according to claim 8, wherein said playing field further comprises:

a collection region disposed underneath said playing field surface to collect said ball after said ball has passed through a hole in said playing field surface.

10. The motion pinball game according to claim 1, wherein said player station comprises a seat, said seat mounted to a support structure that is mounted to a pinball game base, said support structure comprising side, front, and rear walls.

11. The motion pinball game according to claim 1, wherein the playing field has a playing field surface upon which a ball will travel, and wherein a pitch movement and a roll movement of said playing field is controllable by said motion control interface.

12. The motion pinball game according to claim 11, wherein the player station is coupled to said playing field, and wherein said player station undergoes said pitch movement and said roll movement simultaneously with said playing field.

13. The motion pinball game according to claim 11, wherein a player alters a speed of the ball by controlling said motion control interface.

14. The motion pinball game according to claim 13, wherein said playing field comprises a plurality of scoring regions, each of said scoring regions at least partially separated from one another by ridges in said playing field surface.

15. A method of operating a motion pinball game, that comprises a player station, a motion control interface, a playing field having a ball, and a motorized motion platform, comprising:

generating a motion command signal with the motion control interface;

receiving the motion control signal by the motion platform;

generating power assisted movement of the playing field and the player station based on the motion command signal, wherein the motion command signal actuates motors of the motion platform; and propelling the ball across said playing field corresponding to the power assisted movement of the playing field.

* * * * *